United States Patent [19]

Cherry

[11] Patent Number: 5,062,379

[45] Date of Patent: Nov. 5, 1991

[54] METHOD AND APPARATUS FOR CONTROLLING THE SPEED OF BOATS

[76] Inventor: Phillip D. Cherry, 33637 Betts Dr., Zephyrhills, Fla. 33543

[21] Appl. No.: 550,481

[22] Filed: Jul. 10, 1990

Related U.S. Application Data

[63] Continuation-in-part of Ser. No. 441,244, Nov. 27, 1989, abandoned.

[51] Int. Cl.[5] ..... B63B 21/48

[52] U.S. Cl. ..... 114/311

[58] Field of Search ..... 114/294, 311; 244/142, 244/145

[56] References Cited

U.S. PATENT DOCUMENTS

| | | | |
|---|---|---|---|
| 2,536,681 | 1/1951 | Frieder et al. | 114/311 |
| 3,472,195 | 10/1969 | Chiba | 114/311 |
| 3,926,137 | 12/1975 | Johnson | 114/311 |
| 4,632,051 | 12/1986 | Raymond et al. | 114/311 |
| 4,733,628 | 3/1988 | Baughman | 114/311 |

FOREIGN PATENT DOCUMENTS

| | | | |
|---|---|---|---|
| 1443196 | 7/1976 | United Kingdom | 244/142 |

*Primary Examiner*—Jesûs D. Sotelo
*Attorney, Agent, or Firm*—Dominik, Stein

[57] ABSTRACT

A speed reducing device for use from a fishing boat when fishing in a boat moving with the wind and/or a current comprising a rearward portion formed as an essentially circular end panel of water impervious material having the buoyancy to float in water; an intermediate portion formed of a plurality of similarly shaped mesh panels adapted to allow the flow of water therethrough while precluding the passage of debris into the device, each panel having a generally triangular configuration with a rearward edge and side edges converging and meeting at the forwardmost position, the panels being stitched together along the side edges into the general configuration of a cone with the small end of the cone constituting the forward end of the device and with the large end of the cone constituting the rearward end of the device, the end panel being stitched along its periphery to the rearward end of the mesh panels; and a forward portion being formed by the folded midpoints of cords jointly coupled together at the small end of the cone and separately joined at the large end of the cone to the periphery of the end panel. Also disclosed is the method of using such device.

10 Claims, 2 Drawing Sheets

METHOD AND APPARATUS FOR CONTROLLING THE SPEED OF BOATS

RELATED APPLICATION

This application is a continuation-in-part Application of U.S. patent application Ser. No. 441,244 filed Nov. 27, 1989, now abandoned.

BACKGROUND OF THE INVENTION

SUMMARY OF THE INVENTION

This invention relates to a method and apparatus for controlling the speed of boats and, more particularly, to a device having a rearward portion formed of a buoyant imperforate sheet adapted to be pulled behind a fishing boat to reduce its speed and having a forward portion formed in a cone-shaped configuration of mesh adapted to preclude debris from entering into the device.

DESCRIPTION OF THE BACKGROUND ART

One technique in the art of fishing is trolling, i.e., fishing with a moving lure from a slowly moving boat. When fishing from a boat with a trolling motor, it is the practice to power the boat into the wind for reducing the speed of the boat. Trolling at a reduced boat speed increases the tendency to catch fish. Similarly, when trolling without a motor, a strong wind or a rapid current will cause the boat to move too fast and thereby reduce the tendency of the fish to bite. Fishing is thus normally done by powering a boat into the wind to reduce the speed for a maximum catch, or if trolling without a motor, to simply not fish if the wind or current are too strong. As a result, there has long been a need to reduce the speed of a boat moving with the wind or current in order that successful fishing may be accomplished.

Various devices are known in the prior art for being pulled by, or suspended from, a boat or ship. One common device is a sea anchor. A sea anchor is a large canvas bag or sail dragged from the stern of a ship to reduce yawing as in a gale. Variations of such device are disclosed in U.S. Pat. Nos. 4,632,051 to Raymond and 4,733,628 to Baughman. These are, in fact, sea anchors for the conventional sea anchor purpose. In addition, U.S. Pat. No. 3,926,137 to Johnson discloses a device shaped like a sea anchor but functioning like a parachute. The device is formed to include a parachute release. None of these devices is constructed and designed for the purpose of controlling the speed of a boat, particularly a fishing boat being powered for movement in a direction with the wind or current for speed reduction purposes to improve fishing.

As evidenced by the above referred to patents as well as other commercial devices, a wide variety of mechanisms are designed for being used with boats for one purpose or another. No prior patent or commercial device, however, is directed to controlling the speed of boats in the manner as intended herein.

Accordingly, it is an object of the present invention to provide a speed reducing device, and associated method, for use from a fishing boat when fishing in a boat moving with the wind and/or a current comprising a rearward portion formed as an essentially circular end panel of water impervious material having the buoyancy to float in water; an intermediate portion formed of a plurality of similarly shaped mesh panels adapted to allow the flow of water therethrough while precluding the passage of debris into the device, each panel having a generally triangular configuration with a rearward edge and side edges converging and meeting at the forwardmost position, the panels being stitched together along the side edges into the general configuration of a cone with the small end of the cone constituting the forward end of the device and with the large end of the cone constituting the rearward end of the device, the end panel being stitched along its periphery to the rearward end of the mesh panels; and a forward portion being formed by the folded midpoints of cords jointly coupled together at the small end of the cone and separately joined at the large end of the cone to the periphery of the end panel.

It is a further object of the present invention to fish in a boat moving with the wind.

It is a further object of the present invention to reduce the speed of fishing boats travelling in the direction of the wind.

It is a further object of the present invention to drag a speed control mechanism at a variable depth as a function of the site being fished.

Lastly, it is an object of the present invention to utilize mesh in the construction of a speed control device for a boat in order to preclude debris from entering the device.

The foregoing has outlined some of the more pertinent objects of the present invention. These objects should be construed to be merely illustrative of some of the more prominent features and applications of the intended invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

The invention is defined by the appended claims with a specific embodiment shown on the attached drawings. For the purpose of summarizing the invention, the invention may be incorporated into an improved speed reducing device for use from a fishing boat when fishing in a boat moving with the wind and/or a current comprising a rearward portion formed as an essentially circular end panel of water impervious material having the buoyancy to float in water; an intermediate portion formed of a plurality of similarly shaped mesh panels adopted to allow the flow of water therethrough while precluding the passage of debris into the device, each panel having a generally triangular configuration with a rearward edge and side edges converging and meeting at the forwardmost position, the panels being stitched together along the side edges into the general configuration of a cone with the small end of the cone constituting the forward end of the device and with the large end of the cone constituting the rearward end of the device, the end panel being stitched along its periphery to the rearward end of the mesh panels; and a forward portion being formed by the folded midpoints of cords jointly coupled together at the small end of the cone and separately joined at the large end of the cone to the periphery of the end panel.

The invention may also be incorporated into a speed control device for use with a boat, the speed control device comprising a first portion formed of buoyant material and adapted to abate the flow of water therethrough; a second portion formed of a mesh in a generally three dimensional configuration and adopted to allow the flow of water therethrough while precluding the passage of debris into the device, with the rearward end of the second portion being coupled to the periphery of the first portion and constituting the rearward end of the device and with the forward end of the second portion constituting the forward end of the device; and means for coupling the forward end of the device to a line.

The first portion is formed of a material which is impervious to the flow of water therethrough. The second portion is formed in the shape of a cone. The mesh has apertures between about 0.065 and 0.125 inches in their greatest dimension. The device further includes a slit in the second portion of the device between about 6 and 12 inches in length and extending along one of the plurality of seems. The device further includes a plurality of weights positionable within the slit of the device in order to facilitate lowering the device to different depths during operation and use. The means to couple is a barrel swivel attached to the forward end of the device.

The invention may also be incorporated into a method of reducing the speed of a fishing boat when moving with the wind and/or a current comprising (1) providing a device having a first portion formed of buoyant material and adapted to resist the flow of water therethrough, a second portion formed in the general configuration of a cone and adopted to allow the flow of water therethrough with the large portion of the cone being stitched to the periphery of the first portion and constituting the rearward end of the device and with the small portion of the cone constituting the forward end of the device, and means for coupling the forward end of the device to a line; (2) forming a slit in the second portion of the device; and (3) adding weights into the device through the slit in order to facilitate lowering the device to a lower depth during operation and use.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the disclosed specific embodiment may be readily utilized as a basis for modifying or designing other methods and structures for carrying out the same purposes of the present invention. It should also be realized by those skilled in the art that such equivalent methods and structures do not depart from the spirit and scope of the invention as set forth in the appended claims.

DESCRIPTION OF THE DRAWINGS

Shown in the various drawings is a device for carrying out the principles of the present invention.

Similar reference numerals refer to similar parts throughout the various drawings.

DETAILED DESCRIPTION OF THE INVENTION

Figure 1:
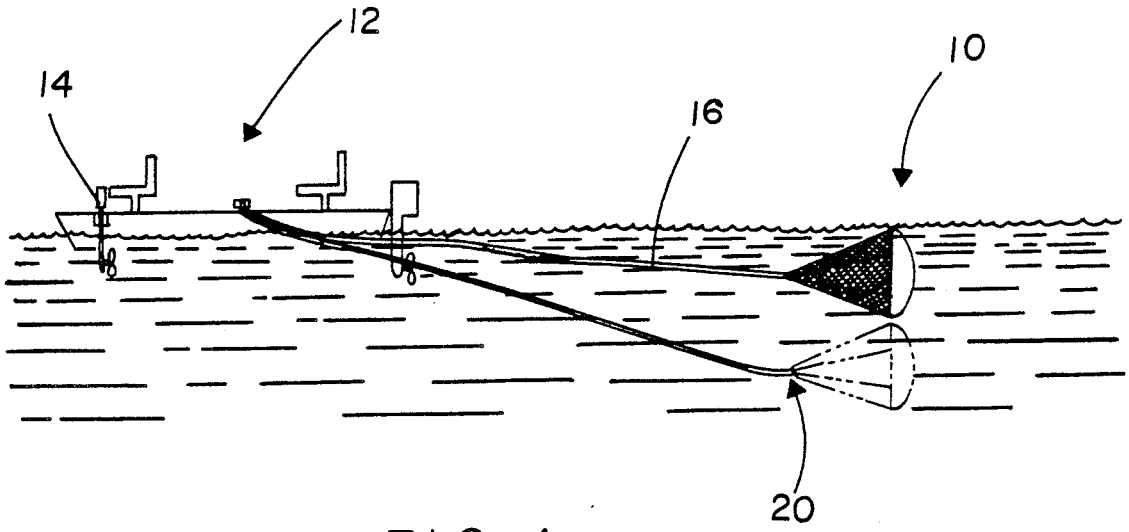
FIG. 1 shows a fishing boat for movement with the wind deploying the speed control mechanism of the present invention.

Shown in the various drawings, with particular reference to FIG. 1, the present invention is illustrated as a speed controlling device or a speed reducing device 10. The device 10 is intended to be used in conjunction with a boat 12, or more specifically, a fishing boat of the type equipped with a trolling motor or motors 14.

The speed controlling device 10 is coupled to the boat 12 by way of a drag line 16. One end, the forward end, of the line 16 is coupled to the boat 12. The other end, the rearward end, is coupled to the device 10 through a barrel swivel 20, preferably of a conventional configuration. The barrel swivel 20 is comprised of a central hollow member 22 and two eyelets 24 and 26. The eyelets 24 and 26 have enlarged parts rotatably positioned within the hollow member 22 of the barrel swivel 20. The forward eyelet 24 couples the end of the line 16 to the hollow member 22 while the rearward eyelet 26 couples the device 10 to the hollow member 22. The construction and deployment of the barrel swivel is such as to allow the device 10 to swivel about the axis of the line 16 in free rotation without twisting the line 16 and inconveniencing the user of the device.

The speed controlling device 10 itself is composed of three sections, a rearward section 30, an intermediate section 32 and a forward section 34.

Figure 2:
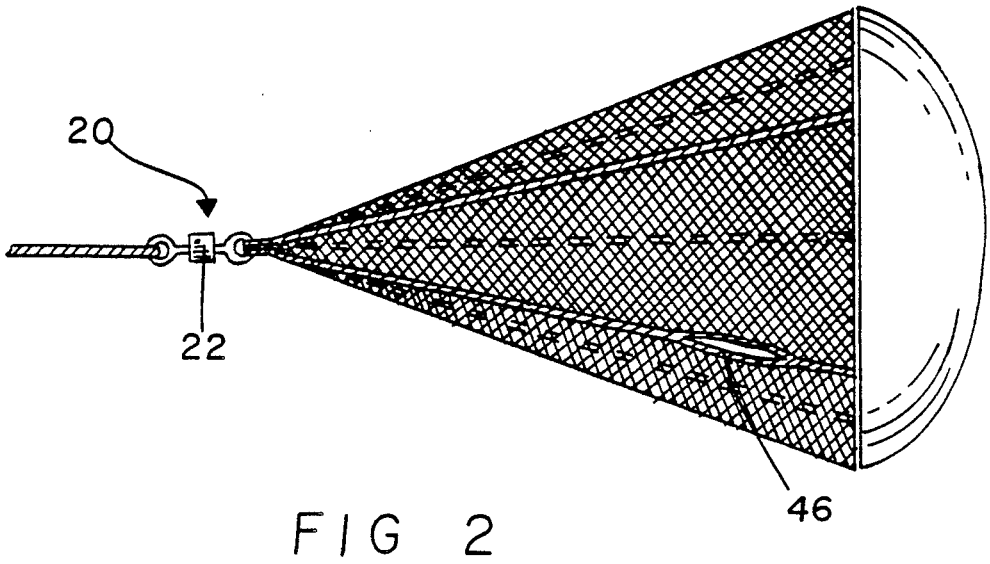
FIG. 2 is an enlarged elevational view of the device for speed control shown in FIG. 1.
Figure 4:
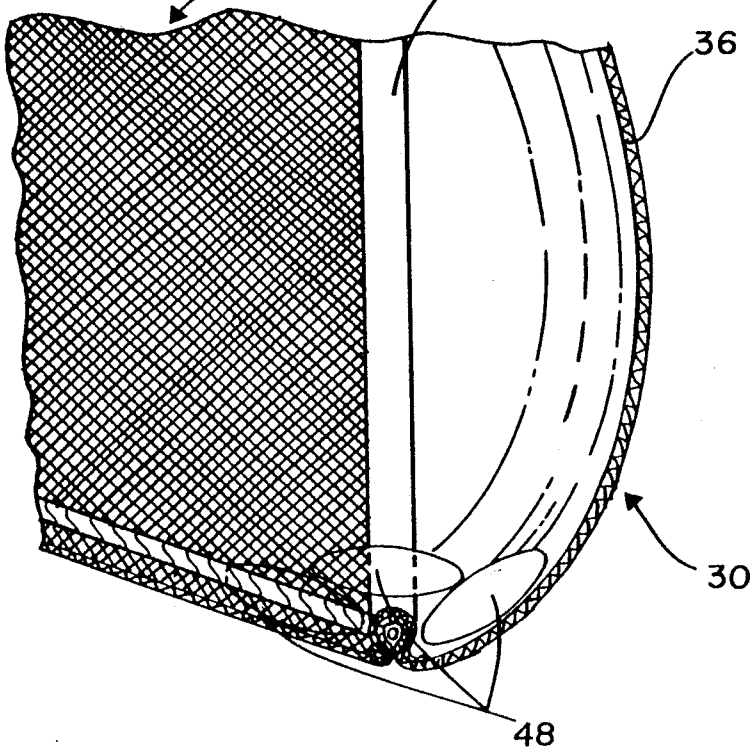
FIG. 4 is a sectional view of the device shown in FIGS. 1 through 3 taken along line 4—4 of FIG. 2, the Figure being a partial fragmentary view.
Figure 3:
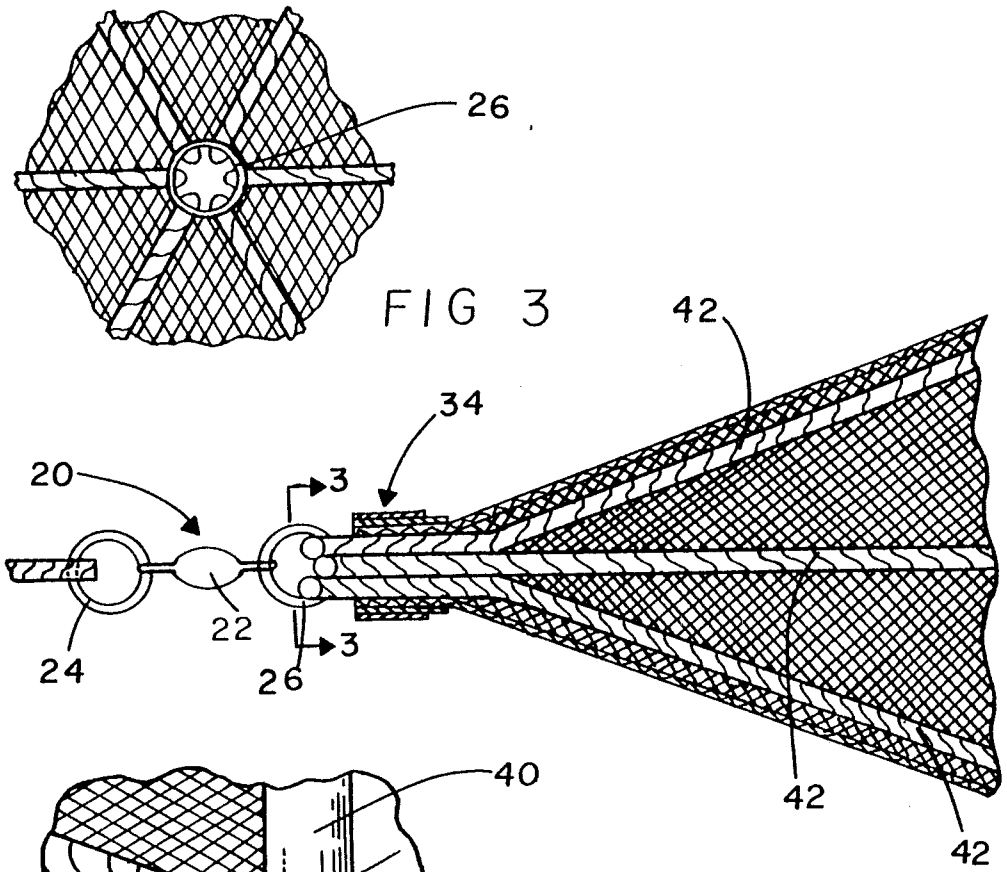
FIG. 3 is an end view of the device taken along line 3—3 of FIG. 2.
Figure 5:
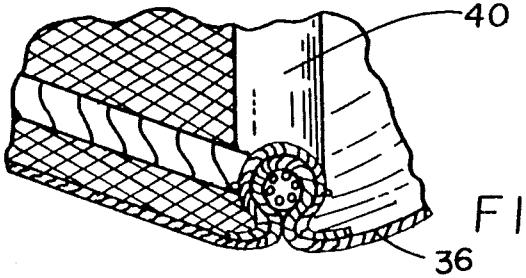

The rearward section is comprised of an essentially circular panel 36. A panel having a diameter from about 18 to about 60 inches has been found to be preferable. The material for the panel is preferably buoyant to allow the device to position itself at about the surface of the water, or at a location slightly beneath the water, when being dragged. In this manner, maximum drag may be achieved. When dragged through the water, the panel will assume an essentially hemispherical configuration under the forces generated as shown in FIGS. 1, 2 and 4. In addition, the material is preferably of such permeability so as to abate the flow of water therethrough. A water impervious material such as a rubberized fabric, natural or synthetic or a blend thereof, is preferred. Other suitable materials include plastic or elastomeric sheet or the like.

The intermediate section is comprised of a plurality panels. The panels are fabricated of a mesh material. The mesh is of such size so as to allow the passage of water therethrough with minimum resistance to the flow of water. The holes which form the mesh, however, are sufficiently small so as to block out or preclude debris and larger particles in the water from passing into the device. Holes with a maximum dimension of about between 0.0625 and 0.125 inches is preferred. Holes with a maximum dimension of about between 0.0316 and 0.250 inches could also be utilized. The panels are triangularly shaped with elongated side edges which taper together in the forward direction. The triangles have their shorter edges at the rearward region of the device. The panels are stitched together along their side edges into a cone-shaped configuration. Other three dimensional shapes could be utilized such as the shape of a pyramid or the like. A thin, light, strong water impervious material such as nylon is preferred. Other suitable materials include rayon, orlon and the like. The cone formed by the cords has a height of about 2 and 4 feet.

The forwardmost section is the small end of the cone where the forwardmost sections of the mesh panels come together. At such location, the forward ends of the panels are stitched to pieces of cord 42 which is looped through the eyelet 26. More particularly, the cords 42, three in the preferred embodiment, are bent at their midpoints to form loops. These loops are secured together by being located within the forward ends of the panels and then stitched together. The ends of the cords 42 extend rearwardly where they are stitched to the end panel and rear edges of the triangular panels. The extents of the cords 42 therebetween extend along the seams of the triangular panels but are unattached to the triangular panels. Their attachment to the front and rear ends of the triangular panels provide support during operation and use.

The intermediate section and the rearward section are joined by a stitching along the periphery of the end panel. The adjacent ends of the mesh panels and the end panel are tucked inwardly and, along with the rearward end of the cords 42, are encased by a binding 40 for being stitched together in a secure manner. The shape of the device is maintained by the cords 42, one adjacent to each longitudinal seam extending from the forward end of the mesh panels to the periphery of the end panel. The rearward end of the cords are stitched to the periphery of the end panel, while the forward end of the cords are stitched to the mesh panels with their central extents looped through the rearward eyelet 26. In practice it has been found that three cords are sufficient with their central point being looped through their rearward eyelet. However, any number of a plurality of cords may be employed. The cords are preferably formed of an inextensible material such as nylon, about from between ⅛ and 1/16 inches in diameter, so that they will not stretch during operation and use for thereby providing support to the end panel. The seams at the edges of the triangular panels are not normally strong enough by themselves for this supporting function. Other suitable cord material include rayon, orlon and the like.

Another important aspect of the invention is a slit or opening 46 formed within one of the seams along the intermediate length of the panel. Such an opening is approximately 6 to 12 inches long. Strips of binding material are preferably provided along the edges of the opening to provide integrity to the opening. In this manner the hand can be reached into the interior of the device for grasping the fabric of the device and for pulling the device inside out for emptying small bits of debris which may have entered the device. Turning the device inside out may also accelerate drying the device after use.

The opening also serves the purpose of allowing the user to add weights 48 to the interior of the device. By adding weights to the device, the device may be allowed to be dragged through the water at different depths. In normal operation and use, a device is dragged close to the surface of the water as shown in FIG. 1 in solid lines. When additional weights are added to the device, it will be dragged at a lower depth beneath the surface of the water. Dragging the device at a lower water level may be needed in environments where more extensive plant life exists in the upper extent of the water adjacent to the water surface.

The particular size of device employed is a function of the boat with which it is to be used, the strength of the wind and/or current, etc. In addition, one or more of such devices may be dragged from the same boat under appropriate conditions. Further, the device or devices are preferably secured to the boat from a cleat adjacent to the forward end of the boat to extend therefrom as a function of the direction of movement of the boat, wind and/or current.

In carrying out the method of fishing from a boat moving in the direction of the wind or the current, whether or not powered by a motor, a device as described above is first provided. A slit is formed in the device. Weights are then added into the device through the slit in order to facilitate lowering the device to a lower depth during operation and use. Regardless of the weights employed or not employed, the pointed forward end of the device will cut through the water blocking out debris and larger particles, precluding them from entering the device, while allowing water to enter into the device. In this manner, the water impervious panel will offer resistance to movement and slow down the device and the boat dragging the device.

The present disclosure includes that contained in the appended claims as well as that of the foregoing description. Although this invention has been described in its preferred forms with a certain degee of particularity, it is understood that the present disclosure of the preferred form has been made only by way of example and numerous changes in the details of construction and combination and arrangement of parts may be resorted to without departing from the spirit and scope of the invention.

What is claimed is:

1. A speed reducing device for use from a fishing boat when fishing in a boat moving with the wind and/or current comprising:

a rearward portion formed as an essentially circular end panel of water impervious material having the buoyancy to float in water;

an intermediate portion formed of a plurality of similarly shaped mesh panels adapted to allow the flow of water therethrough while precluding the passage of debris into the device, each panel having a generally triangular configuration with a rearward edge and side edges converging and meeting at the forwardmost position, the panels being stitched together along the side edges into the general configuration of a cone with the small end of the cone constituting the forward end of the device and with the large end of the cone constituting the rearward end of the device, the end panel being stitched along its periphery to the rearward end of the mesh panels; and a forward portion being formed by the folded midpoints of cords jointly coupled together at the small end of the cone and separately joined at the large end of the cone to the periphery of the end panel.

2. The apparatus as set forth in claim 1 wherein the mesh panels in the intermediate portion are formed with holes having a maximum dimension of between about 0.0625 and about 0.125 inches in their maximum dimension.

3. A speed control device for use with a boat, the speed control device comprising:

a first portion formed of buoyant material and adapted to abate the flow of water therethrough;

a second portion formed of a mesh in a generally three dimensional configuration and adapted to allow the flow of water therethrough while precluding the passage of debris and large particles in the water from passing into the device, with the rearward end of the second portion being coupled to the periphery of the first portion and constituting the rearward end of the device and with the forward end of the second portion constituting the forward end of the device; and means for coupling the forward end of the device to a line.

4. The device as set forth in claim 3, wherein the first portion is formed of a material which is impervious to the flow of water therethrough.

5. The device as set forth in claim 4 wherein the second portion is formed in the shape of a cone.

6. The device as set forth in claim 5 wherein the mesh has apertures between about 0.065 and 0.125 inches in their greatest dimension.

7. The device as set forth in claim 3 and further including a slit in the second portion of the device between about 6 and 12 inches in length and extending along one of the plurality of seems.

8. The device as set forth in claim 7 and further including a plurality of weights positionable within the slit of the device in order to facilitate lowering the device to different depths during operation and use.

9. The device as set forth in claim 3 wherein the means to couple is a barrel swivel attached to the forward end of the device.

10. A method of reducing the speed of a fishing boat when moving with the wind and/or a current comprising:

providing a device having a first portion formed of buoyant material and adapted to resist the flow of water therethrough, a second portion formed in the general configuration of a cone and adapted to allow the flow of water therethrough with the large portion of the cone being stitched to the periphery of the first portion and constituting the rearward end of the device and with the small portion of the cone constituting the forward end of the device, and means for coupling the forward end of the device to a line;

forming a slit in the second portion of the device; and adding weights into the device through the slit in order to facilitate lowering the device to a lower depth during operation and use.

* * * * *